US005342273A

United States Patent [19]

Plendl et al.

[11] Patent Number: 5,342,273

[45] Date of Patent: Aug. 30, 1994

[54] ISOKINETIC EXERCISE HOOP

[76] Inventors: Mathew E. Plendl, 6242 W. 6th St., Los Angeles, Calif. 90048; Vita M. Lucia, 503 N. Hillcrest Rd., Beverly Hills, Calif. 90210

[21] Appl. No.: 197,925

[22] Filed: Feb. 17, 1994

[51] Int. Cl.[5] ..... A63B 21/02

[52] U.S. Cl. ..... 482/126; 482/122

[58] Field of Search ..... 482/126, 139, 49, 110, 482/121, 122, 128; 273/DIG. 7

[56] References Cited

U.S. PATENT DOCUMENTS

| | | | |
|---|---|---|---|
| 1,551,459 | 8/1925 | Blakoe | 482/126 |
| 5,004,226 | 4/1991 | Brown | 482/126 |
| 5,205,798 | 4/1993 | Lekhtman | 482/121 |

FOREIGN PATENT DOCUMENTS

| | | | |
|---|---|---|---|
| 0372309 | 3/1923 | Fed. Rep. of Germany | 482/122 |

*Primary Examiner*—Stephen R. Crow
*Attorney, Agent, or Firm*—Macro-Search Corp.

[57] ABSTRACT

A personal exercise and strength building hoop is disclosed. The hoop has two handles attached at diametrically opposing positions, and are used for grasping the device. The hoop includes a central core made of a flexible, resilient rod material, and further includes a compliant foam outer covering suitable for grasping. The covering is preferably circular in cross-section, while the core is preferably rectangular in cross section. The hoop has a spring constant in diametric compression of approximately 0.4 to 1.6 pounds per inch, and a spring constant in diametric expansion of approximately 1.3 to 3.7 pounds per inch. A person's muscle groups may be exercised over a range of motion of approximately 24 inches in compression and 10 inches in expansion. An auxiliary tensioning device may be removably attached between the handles, or at points between the handles, for increasing the expansion and compression spring constants, respectively. A variety of exercising methods is further disclosed for exercising certain of a person's muscle groups.

9 Claims, 4 Drawing Sheets

ISOKINETIC EXERCISE HOOP

FIELD OF THE INVENTION

This invention relates generally to exercising and muscle building devices and, more particularly, is directed towards an isokenetic exercising hoop device.

BACKGROUND OF THE INVENTION

Hoop-type exercising devices are well known in the prior art. For example, see U.S. Pat. No. 4,480,831 to Mülerr-Deinhardt on Nov. 6, 1984; U.S. Pat. No. 4,315,623 to Granderson on Feb. 16, 1982; U.S. Pat. No. 4,268,031 to Schomburg on May 19, 1981; U.S. Pat. No. 4,049,264 to Holcombe, Jr. on Sep. 20, 1977; and U.S. Pat. 4,022,462 to Pena-Kipper on May 10, 1977.

Such prior art devices are generally rigid hoops useful for exercise by either spinning around one's torso, such as with the well-known "Hula-Hoop" toy, or by repeatedly jumping or skipping over a portion of the hoop by using a "jump rope" type of technique. While such exercises are suitable for aerobic-type exercises, such devices are not effective for muscular strengthening and toning. Further, many muscle groups are not effectively exercised by such prior art devices at all. As many of these prior-art types of exercising devices are made from a rigid plastic material, accidentally striking oneself with such devices can lead to abrasions or bruising, or even more serious injury with strikes to the face. The hoop is used in the well known rhythmic gymnastic exercises which promote form, grace, timing and other kinetic aspects, but not muscle building and strengthening. To accomplish the latter, athletes generally rely upon the well known weight lifting exercises and all the many modern alternatives to the simple weight bench. This latter equipment is complex and expensive to the degree that most utilization of such devices is through the pooling of resources, such as through membership in a health club or gym.

Clearly, then, there is a need for an exercise device that allows moderate exercising of various muscle groups as well as the aerobic-type exercising that is possible with conventional hoop-type exercising devices. Such a needed device would, through various exercise methods, allow nearly all muscle groups to be exercised, stretched and provide for bilateral muscle building. Such a needed invention would be relatively inexpensive to manufacture, as well as safe to use. The present invention fulfills these needs and provides further related advantages.

SUMMARY OF THE INVENTION

The present invention is an exercise and strength building device that takes the shape of a circular hoop. The instant invention has as its primary purpose the attainment of a truly useful strength building device capable of bilateral muscle development. The unique circular shape allows the device to be placed in front of, to one side, above, below and even behind the body, as well as, of course around. No other shape can attain such geometric flexibility with respect to placement of the exercise device for movement of muscles in a vast array of placement and range of motion possibilities.

Its size, shape and resilience were determined through thorough scientific testing and evaluation with a large group of subjects. The hoop of the instant invention, by its unique design, is able to be compressed by two thirds of the diameter repeatedly without work hardening or other degradation of the materials of construction, and also without looping. Looping is the tendency of a hoop to form a figure eight when opposing sides are drawn toward, or away from each other. It may also be extended (pulled in diametric expansion) without fear of breaking or twisting. A large number of rod shapes were tested including both solid and hollow round, square, and rectangular shapes. Materials including plastics, rubbers, metals and exotic materials were tested in many of the design shapes. The materials tested include NYLON (reg. to Dupont), which is not resilient enough, LEXAN (reg. to Dupont), which was neither resilient nor strong enough, and butyrate which was not strong enough for the intended use. Metals were generally too heavy. The material selected after exhaustive testing is a fiber-reinforced epoxy sheet cut into strips of the appropriate width. It is very strong and because the cross-section is flat the ends of the rod can be joined with a lap joint that is as strong as the rest of the material, yet performs with identical flexibility and resilience. The preferred shape is a rectangular cross section solid rod having an aspect ratio of between 5 and 8 with the ideal width being one inch for presenting an ideal cross section, after being covered with a soft foam or rubber grip. Because of the rather limited cross sectional dimensions of the rod, the material must be extremely flexible and yet highly resilient. The workable hoop diameter was determined by exhaustive field trials with a wide variety of subjects. The elbow-to-elbow measurement of hoop diameter is ideal for any size person. A wider hoop provides little leverage for hoop expansion exercising, while a smaller hoop tends to be stiff, and much more difficult to manipulate when used in body encirclement exercises. The hoop has two handles attached at diametrically opposing positions. These are used for grasping the device in the hands or with other parts of the body. The hoop itself includes a structural central core made of a rod stock material that is selected for high resilience and flexibility, and further includes a compliant foam outer covering. The covering is circular in cross-section, while the core is preferably rectangular in cross section, which reduces the tendency toward looping and prevents the outer covering from rotating on the core. The hoop is designed, depending chiefly on the thickness of the core rod, with a spring constant in diametric compression of between approximately 0.4 to 1.6 pounds per inch of total deflection, and in diametric expansion of approximately 1.3 to 3.7 pounds per inch of total deflection. These spring constants fit the exercise and strength building needs of most children and adults from beginners to those with highly developed muscles. A person's muscle groups may be exercised over a range of motion of approximately 24 inches in compression and 10 inches in expansion. The instant invention is superior to simple springs or elastic bands since it allows bilateral exercise, that is, both push as well as pull. Because the instant invention provides for isokinetic movement, it is able to exercise one muscle group at a time which has the great advantage of allowing the exerciser to keep track of progress between muscle groups and to therefore concentrate on those groups which require the most work. Alternately a selected muscle group, may be exercised in deference to all other groups. The obvious advantage here is in the ability to exercise damaged muscles particularly or strengthen the muscles applicable to a particular sport, dance style or the like. An auxiliary tensioning device may be removably attached between the handles, or at mid-points between the handles, for increasing the expansion and compression spring constants, respectively when moving into muscle building approaches.

The present invention is an exercise device that allows isokenetic, bilateral exercising of most of the body's muscle groups as well as facilitating the aerobic-type exercising that is possible with prior-art hoop-type exercising devices. The present device, through various exercise methods, allows nearly all muscle groups to be exercised. Significantly, the device permits exercising over a range of motion and at various positions of the body and limbs. Further, the present invention is relatively inexpensive to manufacture, as well as safe if inadvertently striking a person due to its compliant foam covering. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
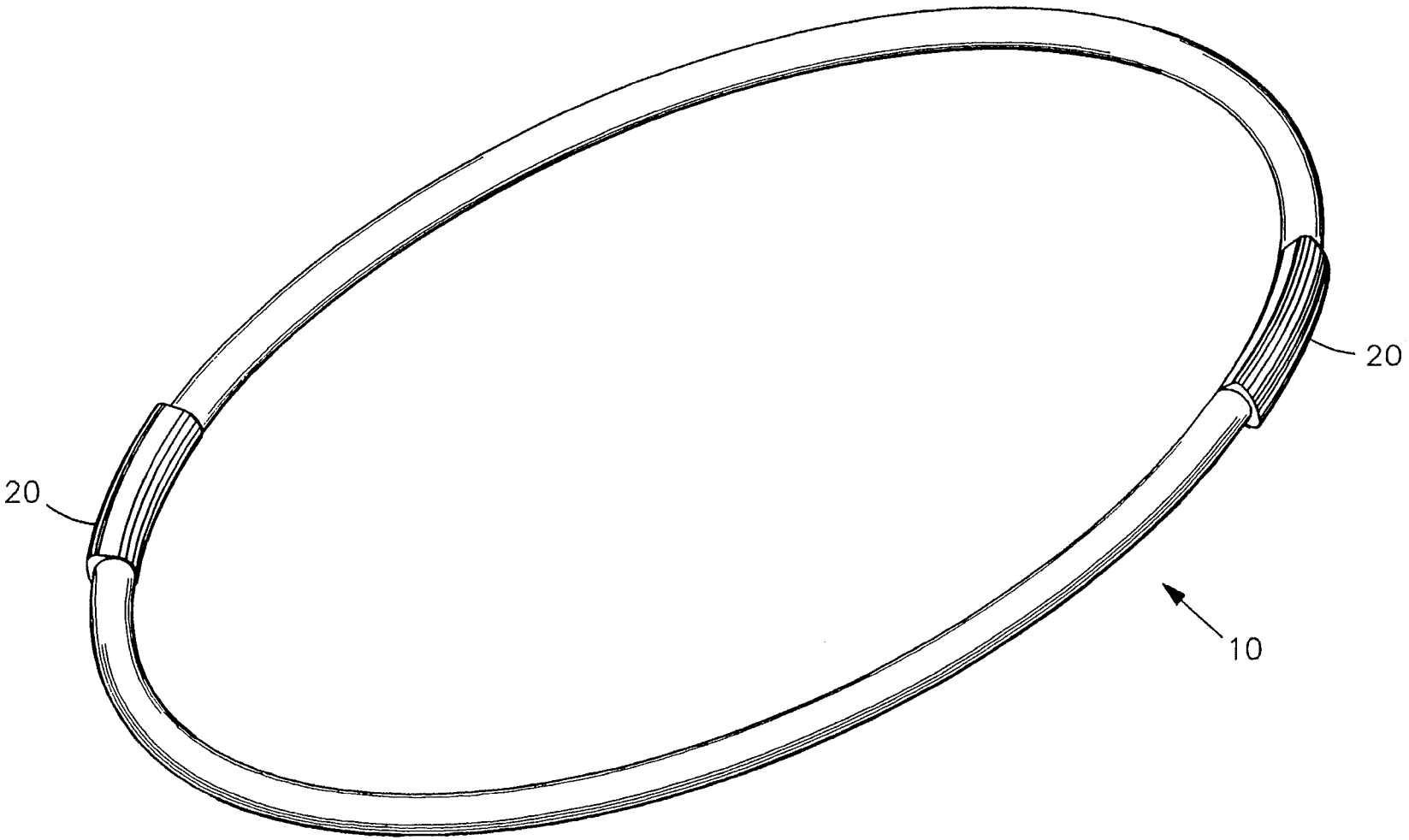
FIG. 1 is a perspective illustration of an isokenetic, bilateral exercising device, illustrating a hoop with diametrically positioned handles.
Figure 2:
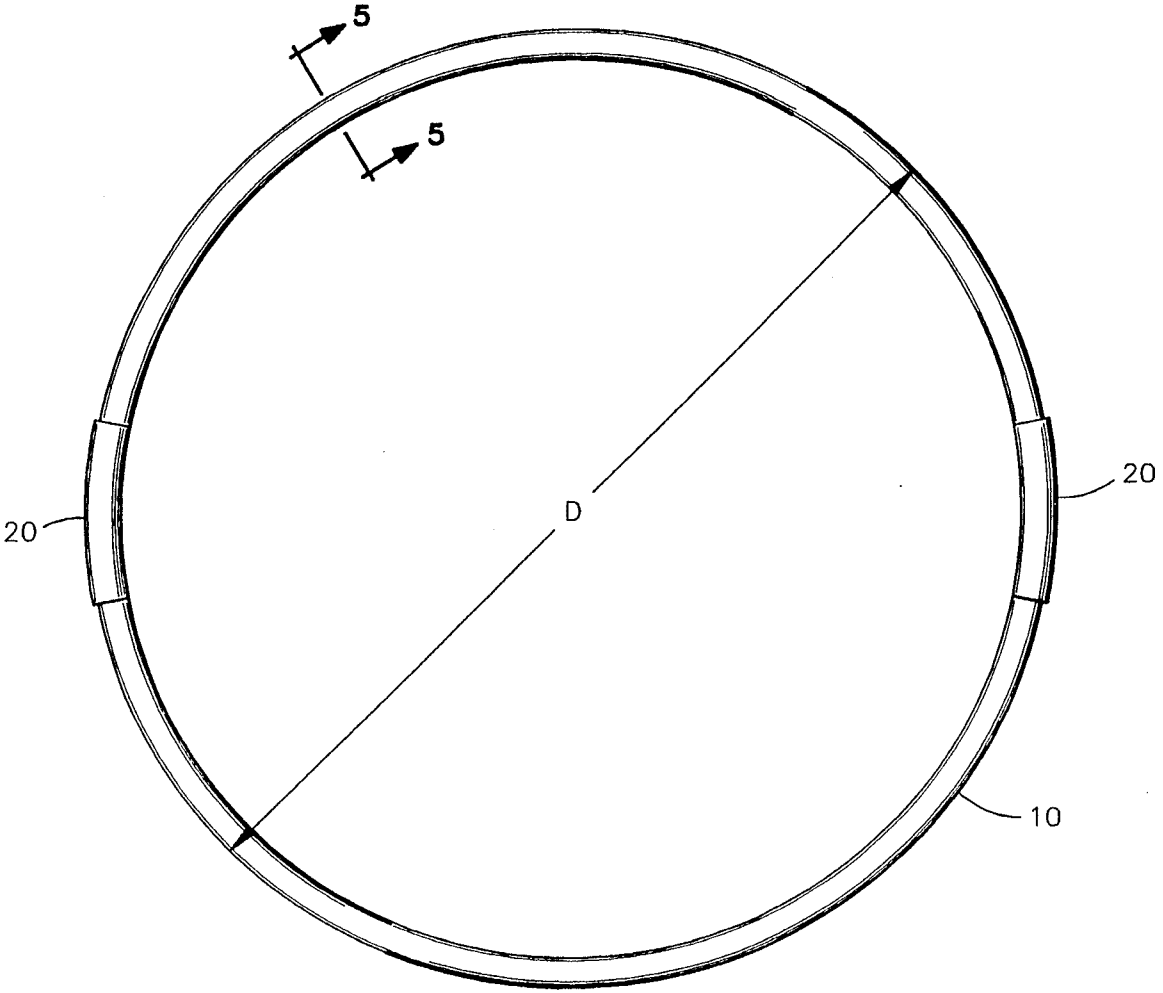
FIG. 2 is a top plan view of the invention, illustrating a diameter D of the hoop of FIG. 1.

FIGS. 1 and 2 show a hoop exercise and strength building device used by a person. A hoop 10 naturally conforms to a circular shape of a diameter D defined as the approximate distance measured between the elbows of the person's outstretched colinearly positioned arms. Such a diameter D remains comfortable to use, easy to handle, and provides an adequate range of motion, and appropriate leverage, for the various exercise methods useful with the device in both compression and extension of the hoop, i.e., bilateral exercising. The hoop 10 is made from an elastic, resilient material such that the hoop 10 prefers a circular shape. That is to say that the hoop 10 will immediately assume the circular shape in the absence of a force that causes the hoop 10 to assume a non-circular shape.

Figure 6:
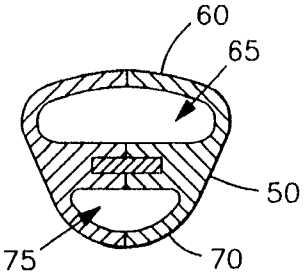
FIG. 6 is a cross-sectional view of the handle of the invention, taken generally along lines 6—6 of FIG. 4, illustrating a central portion, an outer portion, and an inner portion of the handle of the invention.

A pair of handles 20 is attached to the hoop 10 at diametrically opposing positions. Each handle 20 is used for grasping, generally, with one of the person's hands, or other parts of the body or other support surfaces. Preferably, the handles 20 are each of a resilient, high friction coefficient, rubber or plastic material having a central portion 50 within which is embedded the hoop core 30. The handles 20 further include an outer portion 60 and an inner portion 70 integrally joined to the central portion 50 and separated therefrom by an outer void 65 and an inner void 75, respectively. Each void 65,75 is formed by the respective portions 60,70. As such, when each handle 20 is grasped by the person's hand, the person's fingers cause the portions 60,70 to deform into the voids 65,75, respectively, thereby increasing the contact surface area between the portions 60,70 and the person's hand and making lateral slipping of the hands nearly impossible. This increased surface area results in greater frictional forces between the person's hand and the handle 20. Further, as the portions 60,70 are formed from a resilient rubber material, upon compression the portions 60,70 provide a reactive spring force against the person's hand, thereby further increasing the frictional forces therebetween. As a result, the device may be comfortably and safely grasped while the person is applying strong exercising forces to the device. Further, the handles 20 are approximately triangular in cross section (FIG. 6) for additional grasping leverage, comfort and safety while applying forces to the device.

Figure 3:
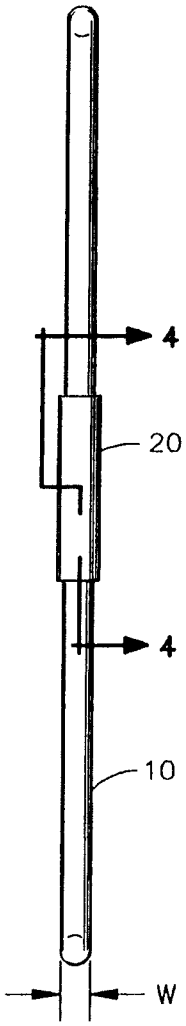
FIG. 3 is a front elevational view of the invention, illustrating a thickness W of the device.
Figure 5:
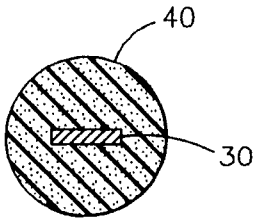
FIG. 5 is a cross-sectional view of the invention, taken generally along lines 5—5 of FIG. 2, illustrating the core and cover of the invention.
Figure 7:
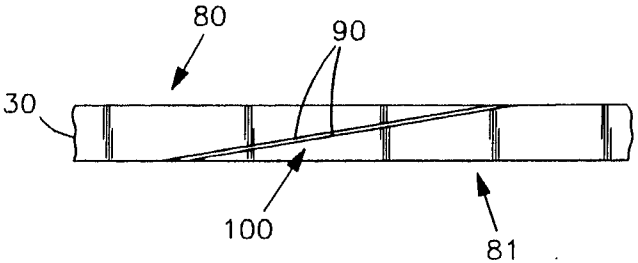
FIG. 7 is a partial side view of the core of the invention, illustrating an overlap joint formed at two planar oblique surfaces of the core.
Figure 4:
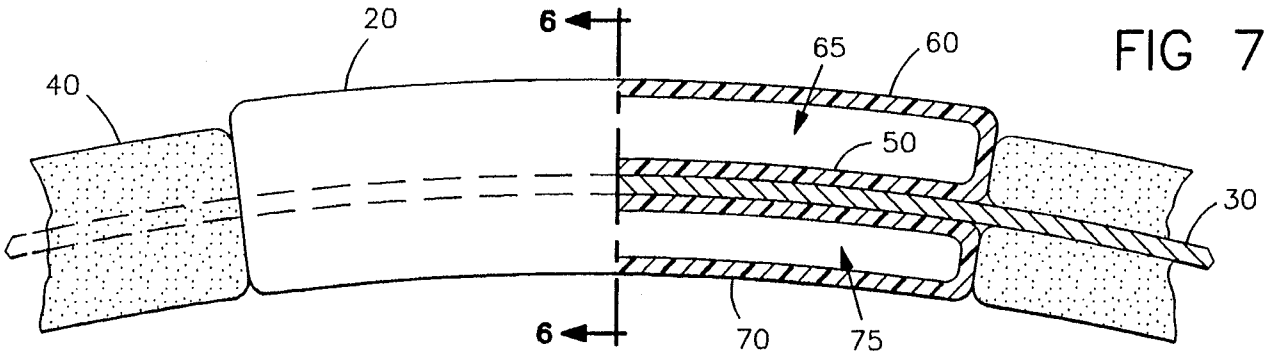
FIG. 4 is a cross-sectional view of the invention, taken generally along lines 4—4 of FIG. 3, illustrating in more detail the handle, a hoop core, and a core cover of the invention.
Figure 9:
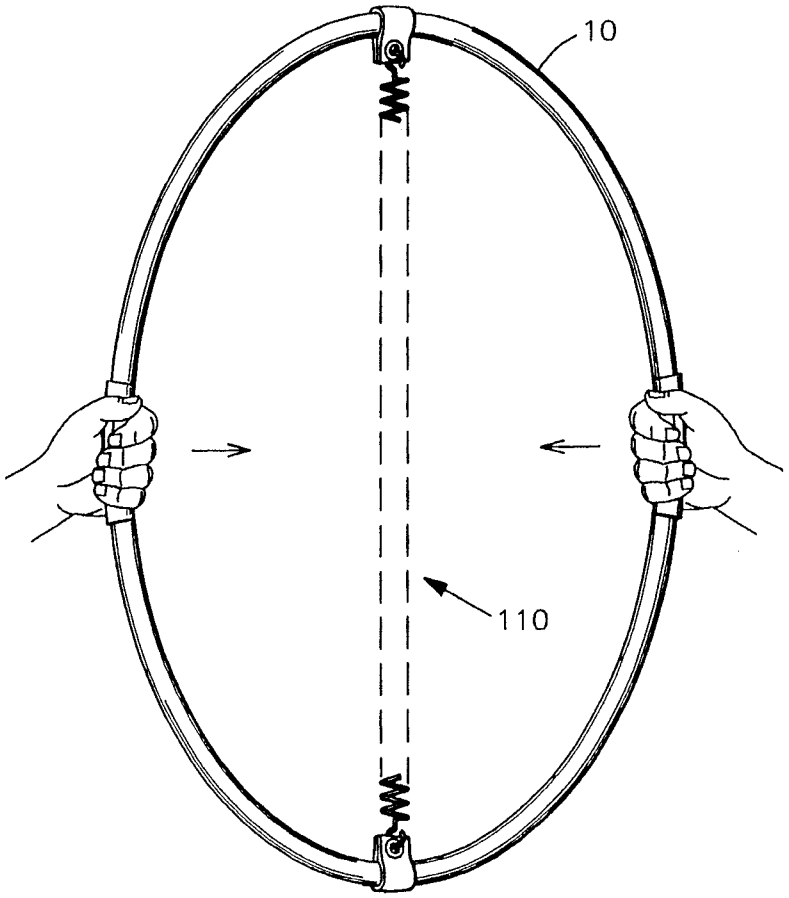
FIG. 9 is a top plan view of the invention, illustrating the tensioning means removably attached at diametric points midway between the two handles.

In the preferred embodiment of the invention, the hoop 10 is of a rectangular cross section rod material forming a core 30. In such an embodiment, the core 30 has a compliant foam cover 40 of circular cross section (FIG. 5). The foam cover 40 is of a width W that it may be easily grasped by the person's hand (FIG. 3). The core 30 is made from a single linear piece of the rod material that has opposing free ends 80,81, each of which provide a planar, oblique surface 90 (FIG. 7). As such, with the core 30 bent into the circular shape with the ends 80,81 overlapping each other, the oblique surfaces 90 are each positioned for full mutual contact for forming an overlap joint 100. The oblique surfaces 90 provide greater bonding surface area than would the surfaces of squared-off ends 80,81. Consequently, a stronger adhesive bonding of the surfaces 90 may be obtained, and such an overlap joint 100 may withstand the pulling forces that are applied to such an exercising device by the person. Preferably, the overlap joint is positioned at one of the handles 20 where strain due to deflection is minimal.

In another embodiment of the invention, the core 30 is made from a pair of identical linear pieces of the rod material. Each piece has the two opposing free ends 80,81 with each providing the oblique surface 90. As such, with the pieces bent into the circular shape with the ends 80,81 of one piece overlapping the ends 80,81 of the other piece, the oblique surfaces 90 are in position for mutual contact for forming two overlap joints 100. Each one of the overlap joints 100 is positioned at one of the handles 20.

The hoop 10 has a spring constant in diametric compression of approximately 0.4 to 1.6 pounds per inch of compressive deflection and a spring constant in diametric expansion of approximately 1.3 to 3.7 pounds per inch of extensive deflection. These spring constants depend upon the thickness of the core rod material which is typically between 0.125 inch and 0.200 inch providing an aspect ratio of from 5 to 8. As such, the device provides appropriate resistance for exercising muscle groups of the person over a range of motion of approximately 24 inches in compression and 10 inches in expansion. The spring constant in diametric compression is generally constant as the handles 20 are pressed towards each other, while the spring constant in diametric expansion increases slightly with increased separation of the handles 20, due to the nature of the hoop shape. This spring constant asymmetry is not critical to the effectiveness of the device.

Figure 8:
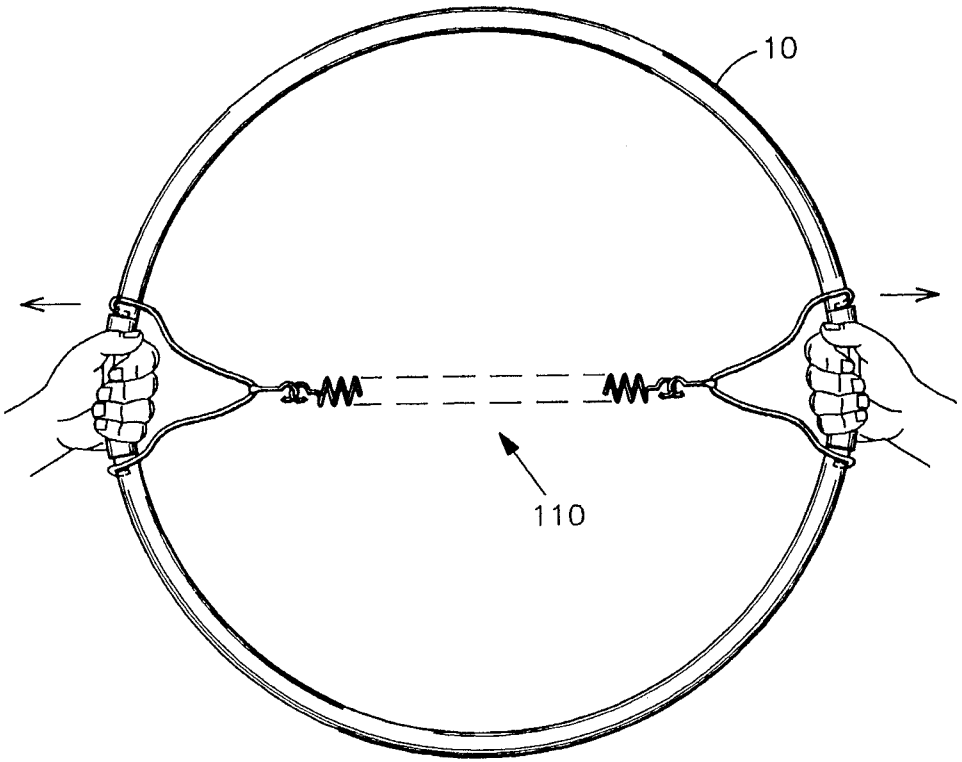
FIG. 8 is a top plan view of the invention, illustrating a tensioning means removably attached between the two handles.

In one embodiment of the invention, a tensioning means 110 is capable of linear extension under tensile force. The tension means 110 is interconnected with the hoop 10 and is removably attached diametrically thereto between the handles 20 (FIG. 8). As such, separation of the handles 20 forces the tensioning means 110 to lengthen, whereby the tensioning means 110 adds to restraining forces resisting the separation of the handles 20. Alternatively, the tensioning means 110 is interconnected with the hoop 30 and removably attached diametrically thereto at points thereon equidistant from the handles 20. As such, movement of the handles 20 toward each other forces the tensioning means 110 to lengthen, whereby the tensioning means 110 adds to restraining forces resisting said movement.

In operation, the device may be used for a variety of muscle exercising, strengthening and possibly building exercises. For example, the pectoralis major, anterior deltoid, and biceps muscle groups may be exercised by holding the hoop in a vertical plane in front of the person by the handles, palms of the hands facing inwardly, and pressing the handles toward each other to compress the hoop 10. The hoop 10 is then allowed to push the handles slowly back to resume the original position while the person applies a slight restraining force. These steps are repeated as necessary. The latissimus dorsi, posterior deltoid, and triceps muscle groups may be exercised by following these same steps except with the palms facing outwardly and pushing the handles 20 away from each other.

The upper sternal fibers of the pectoralis major, mid anterior deltoids, latissimus dorsi, upper trapezious and biceps muscle groups may be exercised by following these same steps except with the hoop 10 positioned horizontally above the persons head, with the arms raised, with the palms facing inwardly, and pushing the handles 20 toward each other. The upper trapezious, mid and anterior deltoids, latissimus dorsi, seratus anterior and triceps muscle groups may be exercised by following these same steps except with the hoop 10 positioned horizontally above the person's head, with the arms raised, but with the palms facing outwardly and pushing the handles 20 away from each other. The biceps muscle groups may be exercised by holding the hoop 10 above the person's head, with upper arms held horizontally, lower arms raised vertically, palms facing inwardly, and pressing the handles 20 towards each other.

The pectoralis minor, lower lats and biceps muscle groups may be exercised by holding the hoop 10 with arms at the person's sides, the hoop 10 encircling the person in a horizontal plane, with palms facing inwardly and pressing the handles 20 toward each other. Another exercise may be done in this same position, except with the palms facing out and pushing the handles 20 away from each other.

The pectoralis major, anterior deltoid and biceps muscle groups may be exercised by holding the hoop 10 in a vertical plane in front of the person with one of the handles pinned to a floor surface by the toes of both of the person's feet, grasping the hoop at each side of the other of the handles 20 with both hands, palms facing downwardly, and pulling the hoop upwardly be bending the arms at both elbows to extend the hoop. The hoop is allowed to pull the hands slowly back to resume the original position while applying a restraining force. These steps are repeated as necessary.

The abdominal muscle groups may be exercised by laying flat on the one's back, grasping the handles 20 with palms facing inwardly, extending the arms at chest level vertically upward, positioning both feet flat on the floor with knees pointed upwardly, lifting one's shoulders slightly off of the floor as one leg is extended through the hoop, and then repeating this last step with the other foot. This is repeated as necessary.

The abdominal muscle groups may be further exercised by laying flat on one's back, grasping one of the handles 20 with both hands, placing both feet on the inside of the hoop 10 at the other handle 20, extending one's legs upwardly at a 90 degree angle, and pressing one's feet and toes upwardly to extend the hoop. The tension on the hoop is then slowly released to bring the feet and toes back to the original position, and this process is repeated as necessary.

The lower body muscle groups may be exercised by laying flat on one's back, placing the hoop 10 between one's thighs just above the knee joint, and then pressing one's thighs together to compress the hoop 10. The tension on the hoop 10 is then slowly released to bring the thighs back to their original position, and this process is repeated as necessary.

With many of these exercising methods, the hoop 10 may be moved while under compression to a different orientation. Such isometric compression of the hoop through a range of motion requires the smooth and efficient transfer of tension through muscle fibers in the same muscle groups, as well as between different muscle groups. This type of muscle coordination is not generally possible with conventional free-weight or other prior art exercising devices.

While the exercises above have been described as unilateral, i.e., requiring work in only one direction for a given exercise, one unique property of the present device is that it provides the ability to exercise in two opposing directions with a nominal, no-stress position between each. For example, the user might alternately compress the hoop, release, and then expand the hoop, release, and then repeat this cycle a suitable number of times.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A hoop exercise and strength building device usable by a person comprising:

a hoop naturally conforming to a circular shape, of a diameter defined as the approximate distance measured between the elbows of the person's outstretched colinearly positioned arms, the hoop being of an elastic, resilient material, of a nature such that when a force on the hoop causes the hoop to assume a non-circular shape is removed, the hoop will immediately resume the circular shape; and a pair of handles attached to the hoop at diametrically opposing positions, each handle for grasping with one of the person's hands in preparation for exercising with the device;

the hoop having a spring constant in diametric compression of approximately 0.4 to 1.6 pounds per inch and a spring constant in diametric expansion of approximately 1.3 to 3.7 pounds per inch whereby the device provides appropriate resistance for exercising muscle groups of the person over a range of motion.

2. The device of claim 1 wherein the hoop is of a rectangular cross section rod material forming a core, the core having a compliant foam cover of circular cross section, the aspect ratio of the cross-section of the rod being between 5 and 8.

3. The device of claim 2 wherein the handles are of a resilient rubber having a central portion within which is embedded the hoop core, and an outer and an inner portion integrally joined to the central portion and separated therefrom by an outer and an inner voids formed by the respective portions, the handles being approximately triangular in cross section, and compressible for comfortable and safe grasping while applying forces to the device.

4. The device of claim 2 wherein the hoop is made of a single linear piece of the rod material having opposing free ends, each providing a planar oblique surface, such that with the rod bent into the circular shape with the ends overlapping each other, the oblique surfaces are in position for mutual contact for forming an overlap joint.

5. The device of claim 4 wherein the overlap joint is positioned at one of the handles.

6. The device of claim 2 wherein the hoop is made of a pair of identical linear pieces of the rod material, each one of the pieces having opposing free ends, each of the free ends providing a planar oblique surface, such that with the pieces bent into the circular shape with the ends of each of the pieces overlapping the ends of the other, the oblique surfaces are in position for mutual contact for forming overlap joints.

7. The device of claim 6 wherein each one of the overlap joints is positioned at one of the handles.

8. The device of claim 1 further including a tensioning means capable of linear extension under tensile force, interconnected with the hoop and removably attached diametrically thereto between the handles such that movement of the handles in mutual separation, forces the tensioning means to lengthen whereby the tensioning means adds to restraining forces resisting said movement.

9. The device of claim 1 further including a tensioning means capable of linear extension under tensile force, interconnected with the hoop and removably attached diametrically thereto at points thereon equidistant from the handles such that movement of the handles toward each other forces the tensioning means to lengthen whereby the tensioning means adds to restraining forces resisting said movement.

* * * * *